US007640773B2

(12) United States Patent
Bellamy et al.

(10) Patent No.: US 7,640,773 B2
(45) Date of Patent: Jan. 5, 2010

(54) LOCK PORTION WITH DEFORMABLE FEATURES

(75) Inventors: Dirk L. Bellamy, Salem, OR (US); Jon Marc Luebeck, Stayton, OR (US)

(73) Assignee: GE Security, Inc., Bradenton, FL (US)

( * ) Notice: Subject to any disclaimer, the term of this patent is extended or adjusted under 35 U.S.C. 154(b) by 0 days.

(21) Appl. No.: 11/255,060

(22) Filed: Oct. 19, 2005

(65) Prior Publication Data

US 2007/0084259 A1 Apr. 19, 2007

(51) Int. Cl.
*E05B 49/00* (2006.01)
*E05B 27/00* (2006.01)

(52) U.S. Cl. ..... 70/496; 70/278.3; 70/278.7; 70/375; 70/416

(58) Field of Classification Search ..... 70/278.7, 70/278.2, 278.3, 375, 490–492, 416–422, 70/493, 495, 496
See application file for complete search history.

(56) References Cited

U.S. PATENT DOCUMENTS

| | | | | | |
|---|---|---|---|---|---|
| 2,660,876 | A * | 12/1953 | Spain | ..... | 70/495 |
| 3,095,726 | A * | 7/1963 | Schlage | ..... | 70/383 |
| 3,479,849 | A * | 11/1969 | Check | ..... | 70/495 |
| 3,500,670 | A * | 3/1970 | Hawkins | ..... | 70/375 |
| 3,563,071 | A * | 2/1971 | Barger | ..... | 70/383 |
| 3,782,143 | A * | 1/1974 | Schlage | ..... | 70/490 |
| 4,282,731 | A * | 8/1981 | Taksony | ..... | 70/493 |
| 4,655,063 | A * | 4/1987 | Foshee et al. | ..... | 70/419 |
| 4,723,427 | A * | 2/1988 | Oliver | ..... | 70/494 |
| 4,848,115 | A * | 7/1989 | Clarkson et al. | ..... | 70/276 |
| 4,854,146 | A * | 8/1989 | O'Connell et al. | ..... | 70/277 |
| 5,479,800 | A * | 1/1996 | Myers | ..... | 70/365 |
| 5,507,162 | A * | 4/1996 | Chhatwal | ..... | 70/278.3 |
| 5,542,274 | A * | 8/1996 | Thordmark et al. | ..... | 70/496 |
| 5,839,307 | A * | 11/1998 | Field et al. | ..... | 70/495 |
| 6,058,751 | A * | 5/2000 | Dimig et al. | ..... | 70/419 |
| 6,442,986 | B1 * | 9/2002 | Russell et al. | ..... | 70/278.3 |

(Continued)

FOREIGN PATENT DOCUMENTS

EP 388997 A1 * 9/1990

OTHER PUBLICATIONS

Blaze, Matt, "Notes on SFIC (Best) Interchangeable Core Locks", http://www.crypto.com/photos/misc/sfic/, accessed: Oct. 17, 2005.

*Primary Examiner*—Peter M Cuomo
*Assistant Examiner*—Christopher Boswell
(74) *Attorney, Agent, or Firm*—Global Patent Operation

(57) ABSTRACT

According to one exemplary embodiment, a portion of a lock may include a stationary member having a bore, where the stationary member can be mountable to an object. The portion of the lock can also include a movable member positioned at least partially within the bore and movable relative to the bore in an unlocking direction during a normal unlocking operation. A deformable portion can be positioned adjacent an interface between the stationary member and the movable member. The deformable portion permits the movable member to move in the unlocking direction during a normal unlocking operation and is deformable to prevent movement of the movable member relative to the stationary member when subjected to excessive force applied in an attempt to move the movable member in the unlocking direction in other than a normal unlocking operation.

20 Claims, 4 Drawing Sheets

U.S. PATENT DOCUMENTS 6,474,122 B2 11/2002 Davis
6,477,875 B2 * 11/2002 Field et al. ..... 70/496
6,526,791 B2 * 3/2003 Shvarts ..... 70/419
6,564,601 B2 * 5/2003 Hyatt Jr. ..... 70/278.3
6,604,394 B2 8/2003 Davis
6,615,625 B2 9/2003 Davis
6,742,368 B1 * 6/2004 Wittwer et al. ..... 70/379 R
6,895,792 B2 5/2005 Davis

* cited by examiner

LOCK PORTION WITH DEFORMABLE FEATURES

FIELD

The present application relates to lock mechanisms, and more particularly, to a lock portion having a deformable feature for increased strength.

BACKGROUND

Conventional lock mechanisms, such as Small Format Interchangeable Core (SFIC) locks, are designed to provide a secure and strong lock in a small space. A typical lock includes the basic components of a body, a rotatable cylinder or plug positioned within the body and a series of pins or tumblers. When locked, the pins extend from the cylinder into the body to prevent rotation of the cylinder relative to the body. A specifically shaped key inserted in a keyhole within the cylinder engages the pins and moves them such that the cylinder is free to rotate relative to the body, thus unlocking the lock.

To provide adequate security, the lock must be configured to resist over-rotation, or over-torque, of the cylinder. Conventionally, the tumblers are designed to resist such over-rotation. For example, most conventional locks employ between five and seven tumblers to resist over-torque of the cylinder. With a greater number of tumblers, however, less space remains available within the lock for other features, e.g., additional security measures.

Therefore, it would be advantageous to develop a lock mechanism that overcomes the drawbacks of known locks.

SUMMARY

Described herein are embodiments directed to a lock with deformable features designed to allow normal operation of the lock, but also designed to deform when an excessive force, i.e., a force in excess of a predetermined force, such as an over-torque, is applied to a secured lock to prevent the lock from unlocking.

According to one exemplary embodiment, a portion of a lock may include a stationary member having a bore, where the stationary member can be mountable to an object. The portion of the lock can also include a movable member positioned at least partially within the bore and movable relative to the bore in an unlocking direction during a normal unlocking operation. A deformable portion can be positioned adjacent an interface between the stationary member and the movable member. The deformable portion permits the movable member to move in the unlocking direction during a normal unlocking operation and is deformable to prevent movement of the movable member relative to the stationary member when subjected to excessive force applied in an attempt to move the movable member in the unlocking direction in other than a normal unlocking operation.

In some implementations, the movable member is rotatable relative to the bore. In specific implementations, the deformable portion includes two spaced apart outwardly extending projections. In other implementations, the deformable portion can include fewer or more than two spaced apart outwardly extending projections. In some implementations, the deformable portion is formed as one piece with the movable member. In yet other implementations, the deformable portion comprises a resilient member, such as, for example, a leaf wire or leaf spring, that is coupled to the movable member.

In some implementations, the portion of a lock can include a locking member engageable with the stationary member and movable member to resist movement of the movable member relative to the stationary member. The locking member can be positioned adjacent the deformable portion such that the excessive force applied to the movable member causes the locking member to deform the deformable portion. In certain implementations, the bore may include a channel and at least a portion of the locking member can be positionable in the channel to place the lock in a locked mode and removable from the channel to place the lock in an unlocked mode. In certain implementations, the deformable portion is positioned along at least one side of the channel adjacent the locking member. In some aspects of the portion of a lock, the locking member can apply a pressure against the deformable portion when the lock is in a locked state and a torsional moment is applied to the movable member.

In some implementations, the portion of a lock can include at least one tumbler positioned within the movable member and contactable with the locking member. The tumbler can be raisable to urge the locking member into engagement with the stationary member and lowerable to move the locking member out of engagement with the stationary member. In certain implementations, biasing elements can be coupled to the at least one tumbler to bias the tumbler in a raised position.

In some implementations, the movable member includes a recess formed therein. The recess can have a ledge portion where deformation of the deformable portion allows the locking member to contact the ledge portion and the stationary portion to prevent movement of the movable member relative to the stationary member.

In some implementations, the portion of the key can include a keyed feature engageable with the moving member to cause the locking member to disengage the stationary member, which allows movement of the movable member relative to the stationary member. In specific implementations, the key can have a memory containing lock access information. The inner core can include an electronic circuit coupled to an actuating device. The circuit can be configured to receive the lock access information stored in the key memory and activate the actuating device to disengage the locking bar from the stationary member.

In another exemplary embodiment, an anti-attack portion of a lock can include a stationary outer body that has a generally circular bore with a channel formed therein. The anti-attack portion of the lock can also include a rotatable generally cylindrical inner core positioned at least partially within the circular bore and rotatable relative to the stationary outer body. The inner core may have a recess formed therein. The anti-attack portion can also include deformable members adjacent an interface between the stationary outer body and the rotatable cylindrical inner core. A movable locking member positioned at least partially within the recess and between the deformable members. A portion of the movable locking member can be engageable with the channel to resist rotation of the inner core relative to the outer body when the lock is in a locked state and disengageable from the channel when the lock is in an unlocked state. Rotation of the inner core relative to the outer body when the lock is in the locked state urges the locking member against at least one of the deformable members. Further rotation exceeding a predetermined torsional force causes the locking member to deform at least one of the deformable members, thereby preventing rotation of the inner core relative to the outer body.

In some implementations, the deformable members can comprise one or more projections extending from the cylindrical core. In other implementations, the deformable members can comprise one or more resilient members, such as, but not limited to, a spring wire or leaf spring, coupled to the cylindrical core.

In some implementations, the portion of the movable locking member can be movable away from the channel to place the lock in an unlocked state and allow rotation of the inner core relative to the outer body. The anti-attack portion of a lock can also include a key engageable with the rotatable cylindrical inner core where the key manipulates a mechanism and allows the locking member to move away from the channel. In specific implementations, the key can have a memory containing lock access information. The inner core can include an electronic circuit that is coupled to an actuating device. The circuit can receive the lock access information stored in the key and activate the actuating device to move the locking member away from the channel.

In some implementations, one or more movable tumbler pins can be positioned within the inner core and coupled to the locking member. The tumbler pins are blocked to maintain engagement between the locking member and the channel or unblocked to allow the locking member to disengage from the channel.

The foregoing and other features and advantages of the present application will become more apparent from the following detailed description, which proceeds with reference to the accompanying figures.

DETAILED DESCRIPTION

Embodiments of a lock with deformable features that allow normal operation of the lock, but deform to prevent operation of the lock when a force above a predetermined threshold is applied to a secured lock (i.e., a "locked" lock) are described herein. As used herein, deformable features refers to structural elements in the lock that deform from their normal configuration to a deformed configuration when subjected to excess force. The deformed features may be irreversibly deformed, e.g., due to bending, breaking or other type of mechanical deformation, or they may be reversibly deformed, i.e., changed in shape or position from their normal configuration and capable of being returned to their normal configuration after they are subjected to the excess force (e.g., springs or other resilient elements).

Figure 1:
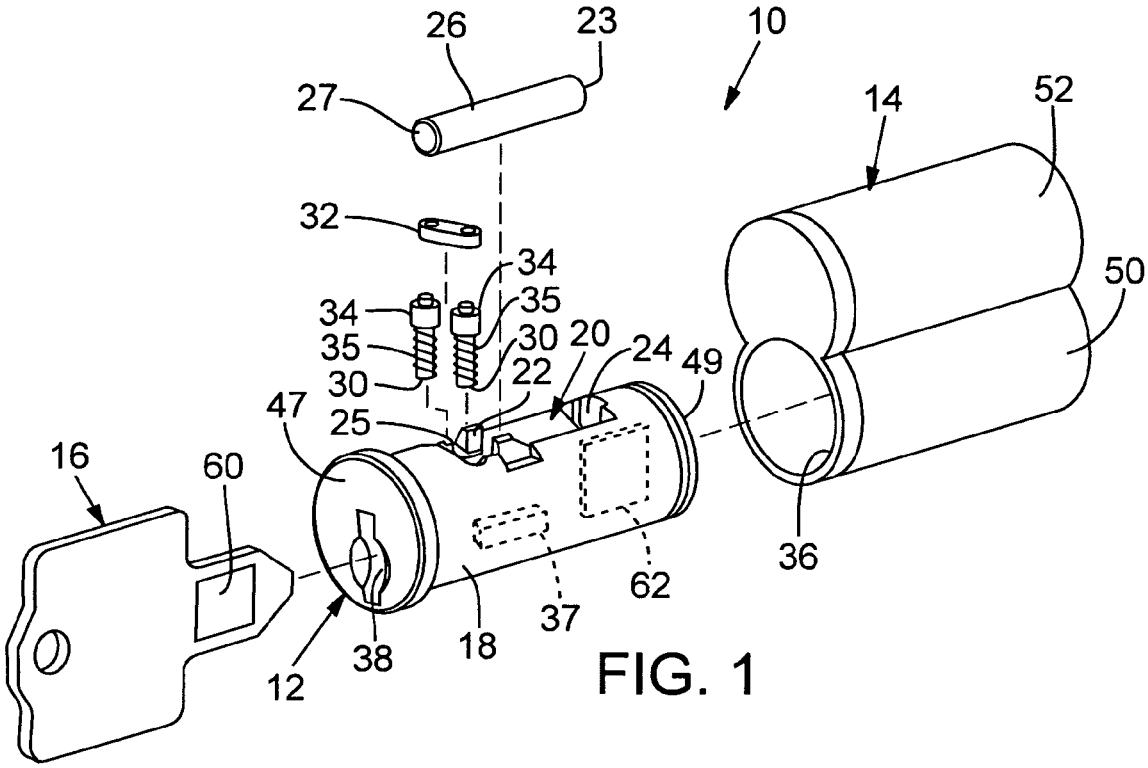
FIG. 1 is an exploded perspective view of an exemplary embodiment of a lock mechanism with deformable features.
Figure 2:
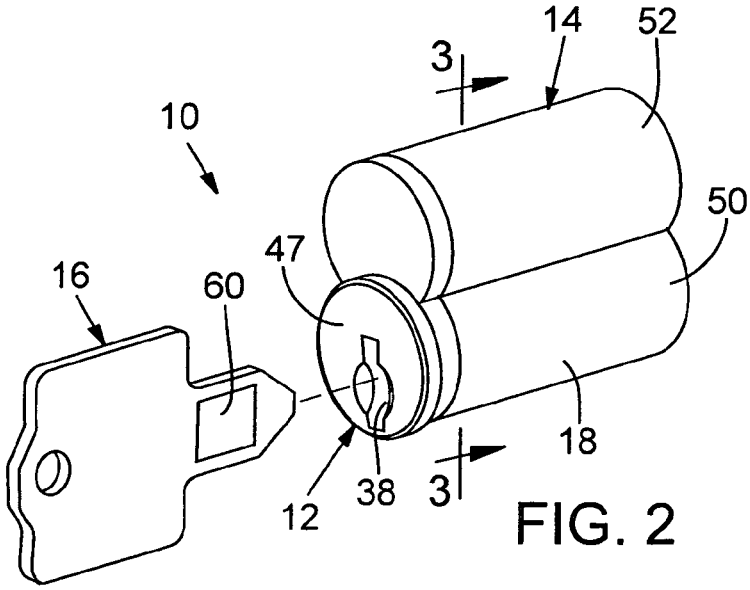
FIG. 2 is a perspective view of the lock mechanism of FIG. 1 shown in an assembled state and with a key for operating the lock.

Referring to FIGS. 1 and 2, according to one exemplary embodiment, a deformable lock mechanism, or system, 10 includes a movable member, e.g., a rotatable inner core 12, operatively coupled to a stationary member, i.e., an outer body 14, and a key 16 engageable with the rotatable inner core 12. As with conventional locks, the lock mechanism 10 can secure a container or object. For example, the inner core 12 can be coupled to a latching mechanism, such as a cam and bolt, that is engageable with a secure portion of a container or object, such as a door frame or safe wall. Rotation, or other movement, of the inner core 12 disengages the latching mechanism from the secured container or object to gain access to the container or objects.

Advantageously, the outer body 14 can have the same outer configuration as a conventional lock, such that the lock system 10 can be used to retrofit a conventional lock. For example, the outer body could have a SFIC-type outer configuration.

The rotatable inner core 12 includes a plug 18 having a generally cylindrical shape. An elongate locking member receiving recess 20 can have a generally v-shaped cross-section with a curved vertex 43 and a ledge 45 extending away from the vertex (best shown in FIG. 7). The recess can extend generally parallel with an axis of the plug 18 and can be formed in an outer surface of the plug intermediate a first front, or key receiving, end 47 and a second rear end 49 of the plug. Spaced apart deformable members can be attached to or formed as one piece with the rotatable inner core 12 or the outer body 14.

For example, as shown in FIG. 1, deformable members, such as projections 22, can be integral with the recess 20 of the inner core 12 and positioned intermediate a locking bar pivoting end 24 and a tumbler receiving end 25 of the recess. The projections 22 are spaced apart a distance slightly greater than a width of a locking member, such as locking bar 26, and facilitate at least partial vertical alignment of a locking bar 26 as the bar moves through its nominal range of motion, as will be described below in more detail.

Figure 8:
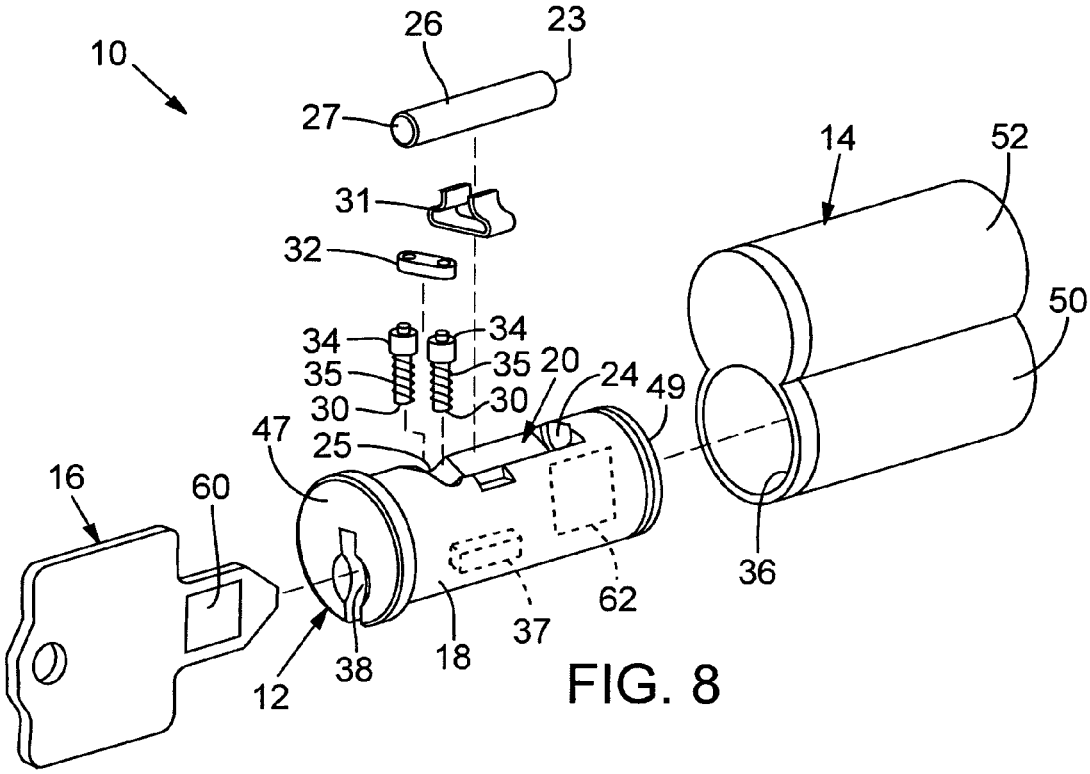
FIG. 8 is an exploded perspective view of a lock mechanism similar to FIG. 1, except the deformable feature is a resilient member.
Figure 9:
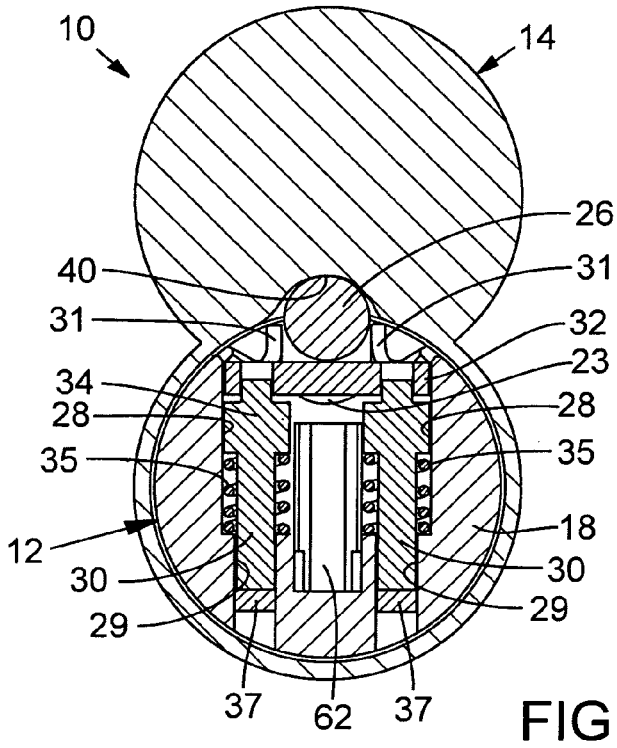
FIG. 9 is a cross-sectional elevational view of the lock mechanism of FIG. 8 shown in a locked state.

Alternatively, or in combination with the projections 22, the deformable members can be one or more resilient members 31 (FIGS. 8 and 9). The resilient member or members 31 can be integral with the rotatable inner core 12, integral with the outer body 14, or be one or more separate parts coupled to the inner core 12, as shown in FIG. 8, or outer body 14. The resilient member 31 could be, for example, one or more spring wires and/or leaf springs.

In the illustrated embodiments, the locking member is a locking bar 26 having a generally elongate cylindrical shape with a slightly rounded pivoting end 23 and an outer body engaging end 27. The locking bar 26 can be a standard hardened dowel pin.

Figure 3:
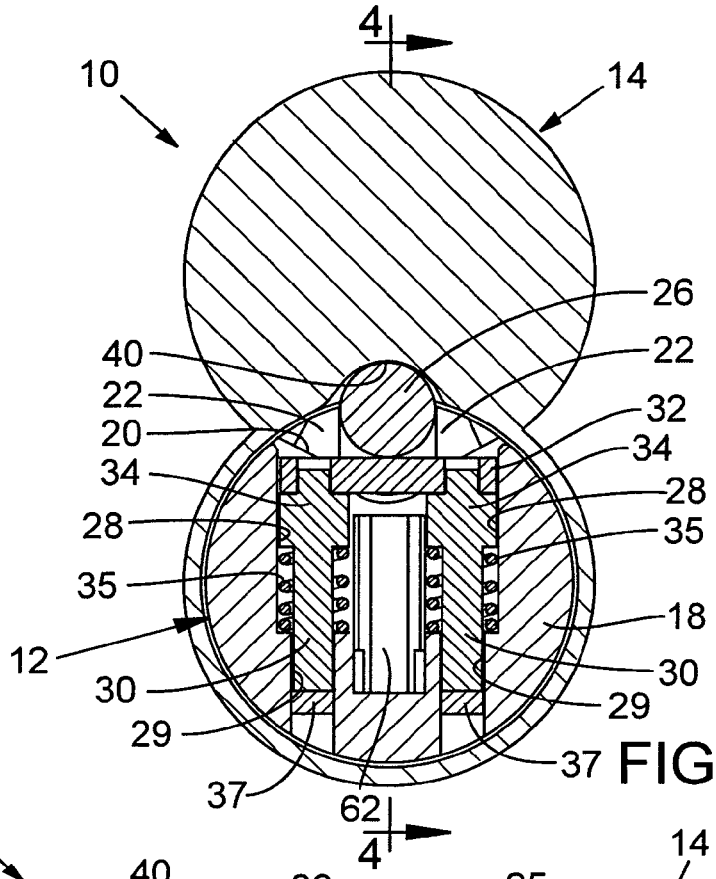
FIG. 3 is a cross-sectional elevational view of the lock mechanism of FIG. 2 taken along the line 3-3 in FIG. 2, the lock mechanism being shown in a locked state.
Figure 4:
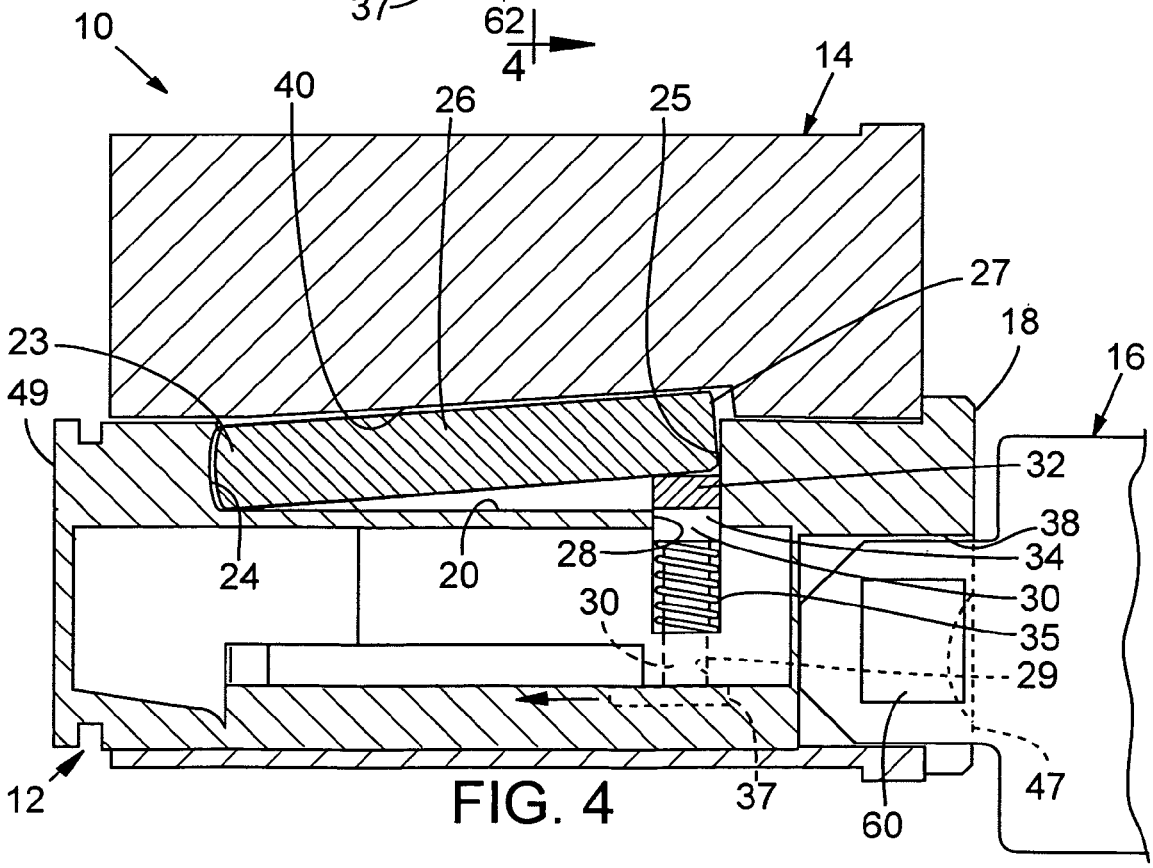
FIG. 4 is a cross-sectional side view of the lock mechanism of FIG. 3 taken along the line 4-4 in FIG. 3.

The pivoting end 24 of the recess 20 can be slightly cupped and configured to receive the rounded pivoting end 23 of the locking bar 26 and to facilitate movement of the bar relative to the recess, such as vertically oriented rotation of the bar about its pivoting end when coupled to the recess 20. The tumbler receiving end 25 of the recess 20 can include a slot, or opening, 28 and adjoining openings 29 extending perpendicular to the axis of the plug 18 with each opening having a smaller cross-section than the slot (FIGS. 3 and 4). The slot 28 is sized to receive two tumbler pins 30 and a support element 32, and each opening 29 is configured to receive and align a respective tumbler pin. The support element 32 includes spaced apart openings through which each tumbler pin 30 extends up to a stop 34 formed in or coupled to the pins 30. Biasing elements, such as compression springs 35, can be coupled to the pins 30 and a tumbler stopping member, or members, 37 can be selectively movable to a position underneath the tumbler pins 30 to prevent downward movement, i.e., movement away from a channel 40, as will be discussed below, of the tumbler pins. With the tumbler pins 30 being prevented from downward movement, engagement between the locking bar 26 and the channel 40 is maintained.

The plug 18 can include a keyhole 38 extending from the key receiving end 47 of the plug and sized to receive the key 16 (FIG. 1). In the illustrated embodiments, the key 16 is an "uncut" key having a generic configuration (with the individualized function of the key being performed by the circuit 60 discussed below).

Referring now to FIGS. 3 and 4, the rotatable inner core 12 can be assembled by coupling the springs 35 to the tumbler pins 30 and inserting each tumbler pin into the slot 28 and a respective opening 29 such that the springs are positioned between the tumbler pin stops 34 and the openings 29. The support element 32 is inserted into the slot 28 such that upper ends of the tumbler pins extend into the openings in the support element and the support element rests on an upper surface of the stop 34. In this position, the springs 35 urge the tumbler pins 30 upward such that the upper surface of the support element 32, with the springs fully extended, is elevated above a lower surface of the recess 20. The locking bar 26 is positioned within the recess 20 and between the projections 22, or alternatively, as shown in the embodiment illustrated in FIG. 9, between an at least partially flexible portion of the resilient member 31, such that the rounded pivoting end 23 of the bar contacts the cupped portion 24 of the recess and outer body engaging end 27 of the bar contacts an upper surface of the support element 32. The locking bar 26 is thus angled with respect to the axis of the plug 18 such that the rounded pivoting end 23 is positioned lower, i.e., closer to the axis of the plug 18, than the outer body engaging end 27 and the end 27 extends outwardly beyond the outer surface of the plug 18.

Referring back to FIG. 1, the outer body 14 includes a bore 36 extending through the body. The bore 36 has an inner diameter just larger than an outer diameter of the plug 18, i.e., sized to rotatably receive the plug 18. The bore 36 can include a locking member receiving channel 40 formed in a sidewall of the bore and extending generally parallel to an axis of the bore 36 (see FIGS. 3 and 4). The channel 40 is positioned intermediate and generally away from the ends of the bore 36.

The channel 40 is sized and shaped to matingly receive the outer body engaging end 27 of the locking bar 26, when aligned with the channel. In the illustrated embodiments, the locking member receiving channel 40 has a generally semicircular cross-section with a radius corresponding to a radius of the locking bar 26. In other embodiments, the locking member can be a locking bar having other elongate shapes, such as, for example, rectangular, triangular and ovular, and the channel can be similarly sized and shaped. Alternatively, the locking member can be a non-elongated element, such as a sphere, with a correspondingly sized and shaped channel.

As shown in the illustrated embodiments, in some implementations, the outer body 14 can be designed for accommodation in most lock receiving devices. For example, the outer body 14 can include a lower bore containing portion 50 having a cylindrical shape adjoined to an upper securing portion 52 also having a cylindrical shape. In other implementations, the outer body 14 can have a generally rectangular, circular, triangular, or other desirable shape.

The assembled rotatable inner core 12 is inserted into the lock bore 36 formed in the outer body 14 (FIG. 2). As the inner core 12 is inserted into the bore 36, the portion of the locking bar 26 extending outwardly away from the outer surface of the plug 18 contacts a sidewall of the bore 36, which exerts an inwardly directed pressure, which overcomes the biasing force of the springs to urge the locking bar 26 inwardly, i.e., toward the axis of the plug 18. In this position, the entire locking bar 26 is approximately flush with the outer surface of the plug 18. As the inner core 12 is properly inserted into the bore 36 and the locking bar 26 of the rotatable core 12 is aligned with the locking member receiving channel 40 of the bore, the outwardly biasing springs 35 urge the tumbler pins 30, support element 32 outwardly and the outer body engaging end 27 of the locking bar correspondingly moves outwardly and into the channel 40. The tumbler stopping member 37 is then moved underneath the tumblers 30 to place the lock mechanism 10 in a locked position or state (see, e.g., FIGS. 3, 4 and 9).

With fewer components in the inner core and the outer body, the lock mechanism 10 conserves more interior space for future expansion and additional functionality than conventional locks.

As an individual seeks unauthorized access to the lock mechanism 10 when in the locked state, such as by inserting an incorrect key into the keyhole 38 and applying a torsional force or moment less than a predetermined maximum torsional force to the rotatable inner core 12, the locking bar 26, being prevented from moving downwardly away from the channel 40 by the tumbler stopping member 37, at least partially engages the channel 40 and a projection 22, or resilient member 31, to prevent rotation of the inner core relative to the outer body 14. If the applied torsional force meets or exceeds the predetermined maximum torsional force, such as by aggressive tampering of the lock mechanism 10, the deformable projections 22 are configured to deform or collapse from the pressure being applied to them by the locking bar 26. In implementations using resilient members 31, as described above in relation to FIGS. 8 and 9, the members can be configured to substantially resist deformation, e.g., by flexing, up to the predetermined maximum torsional force, but allow deformation upon reaching or exceeding the predetermined maximum torsional force.

Figure 5:
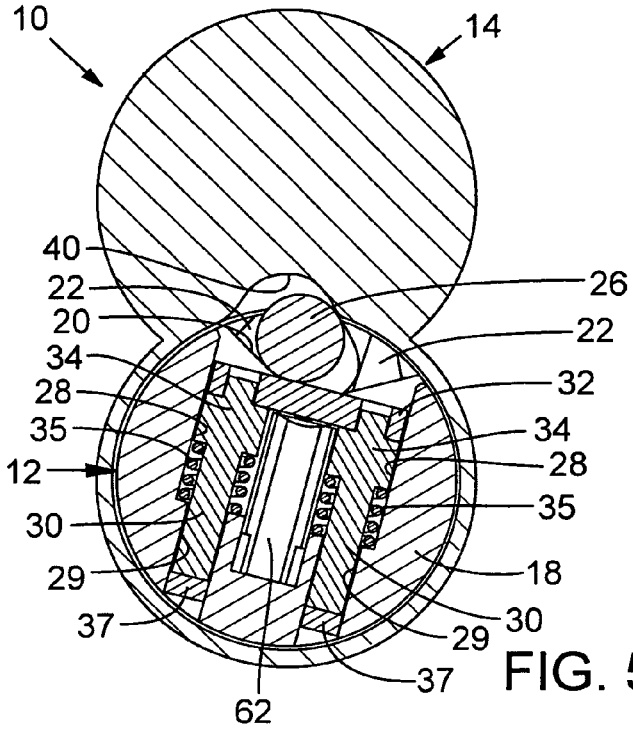
FIG. 5 is a cross-sectional elevational view of the lock mechanism of FIG. 2 taken along the line 3-3 in FIG. 2, the lock mechanism being shown in an inoperable state following deformation of the deformable features.

As shown in FIG. 5, deformation of the projections 22 allows the outer body engaging end 27 of the locking bar 26 to move partially out of, but remain in contact with, the channel 40 and into the void created by the collapsed projection, which allows the rotatable inner core 12 to rotate slightly. The outer body engaging end 27 of the locking bar 26 moves (with the rounded pivoting end 23 remaining in contact with the pivoting end 24 of the recess 20) and the rotable inner core 12 rotates until the end 27 slides off of the support element 32 and contacts the ledge 45 of the recess 20. With the locking bar 26 in contact with the ledge of the recess 20 and the channel 40, any further rotation of the inner core 12 causes the channel and recess to deform slightly under pressure by the locking bar to effectively wedge the locking bar between the ledge of the recess and the channel. The bar being immovably wedged between the recess 20 and the channel 40 disables the lock mechanism 10 and prevents access, authorized or unauthorized, to the lock mechanism 10, i.e., places the lock in an unoperable state.

Once a projection 22 is deformed and the locking bar 26 is permanently wedged between the ledge 45 or upper surface of the recess 20 and the channel 40, the lock mechanism 10 is effectively inoperable and must be replaced. Accordingly, the predetermined maximum torsional force should correspond to a level beyond the maximum torsional force an individual seeking authorized access to the lock mechanism would apply to the inner core 12.

In embodiments where the deformable members are one or more resilient members 31, as shown in FIGS. 8 and 9, deformation of the resilient member or members 31 allows the outer body engaging end 27 of the locking bar 26 to move in a manner similar to that described above in relation to embodiments using projections 22 except that the end 27 moves into the void created by the deformed, or flexed, resilient member 31. The end 27 moves until it slides off of the support element 32 and contacts the ledge of the recess 20 and the channel to prevent further rotation of the inner core 12 relative to the outer body 14. However, unlike the deformable projections 22, the resilient members 31 in a deformed, or flexed, state can be configured to exert a biasing force on the locking bar 26 such that the bar does not cause deformation of the channel and recess. Accordingly, the lock is not rendered inoperable and the resilient members 31 move the locking bar 26 back into engagement with the channel 40 once the predetermined maximum torsional force applied to the inner core is relaxed.

Figure 6:
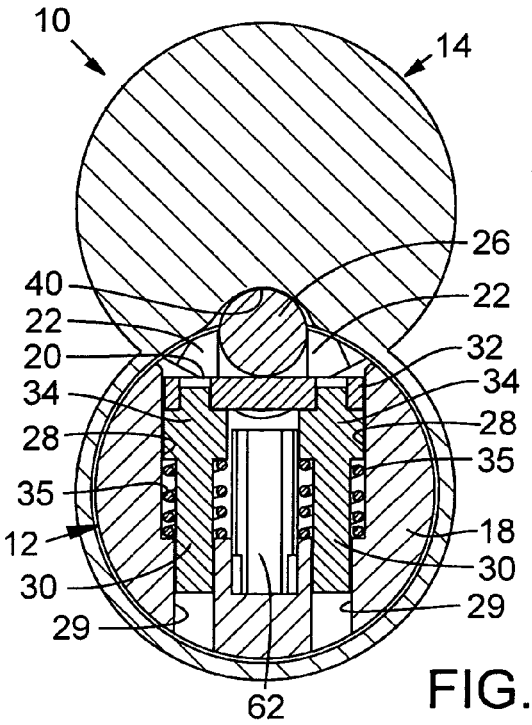
FIG. 6 is a cross-sectional elevational view of the lock mechanism of FIG. 2 taken along the line 3-3 in FIG. 2, the lock mechanism being shown in an unlocked state.
Figure 7:
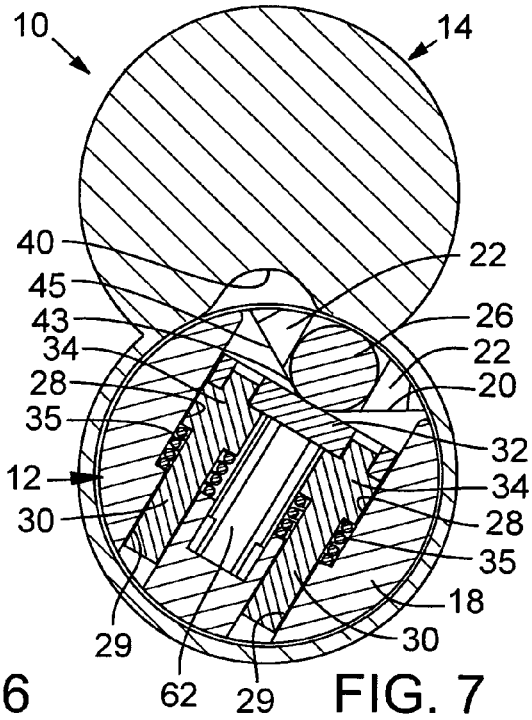
FIG. 7 is a cross-sectional elevational view of the lock mechanism of FIG. 2 taken along the line 3-3 in FIG. 2, the lock mechanism being shown in an unlocked state with the locking member disengaged from the receiving channel in the stationary member and the movable portion rotated.

In contrast, a user seeking authorized access can insert an authorized key 16 into the keyhole 38. Upon insertion of an authorized key 16, the tumbler stopping member 37 within the rotatable inner core 12 is moved from a position opposite the tumbler pins 30 as shown in FIG. 5, such as in the inward direction indicated by the arrow, to place the lock in an unlocked state (see also FIG. 6). With the tumbler pins 30 unrestrained from downward movement by the tumbler stopping member 37, the user's rotation of the key causes the plug 18 to rotate and the locking pin 26 to move downwardly as a result of its interaction with the channel 40. Further rotation of the plug 18 urges the locking pin 26 to slide out of the channel 40 and slide along the inner surface of the outer body bore 36 (FIG. 7). The user is then allowed to unobstructively rotate the inner core 12 relative to the outer body 14 to disengage a latch or other securing element coupled to the inner core and access a secured area.

In some embodiments, the key can be an access device with one or more electrical components that communicate with and/or transfer power to the lock. In the illustrated embodiments, the key 16 is a mechanical key with an electronic memory portion 60 containing user identification information or access code information readable by a micro-processor based circuit 62 housed in the plug 18. The circuit 62 can include a solenoid or other device (not shown), such as a motor, magnet, or other similar device. The solenoid can be selectively controllable to "unlock the lock," i.e., to move or release the tumbler stopping member 37 from underneath the tumbler pins 30, when the information read by the circuit indicates access is authorized.

In some implementations, power and information transfer between the memory portion of the key and the circuit of the outer body can be initiated by inserting the key into the outer body to establish electrical contact between the memory and the circuit.

In other implementations, the memory portion of the key can communicate wirelessly with the circuit of the outer body, such as, for example, via an infrared or RF communications link, to transmit information between the memory portion and the circuit. In certain implementations, the key can function to wirelessly transfer signals, information or energy to the lock to change the lock to an unlocked state when positioned near, but not in contact with the lock. Thereafter, the key is inserted into the lock and rotated to access the secured area. In other implementations, the key can be inserted into the lock to wirelessly transfer information to the lock to place the lock in an unlocked state with a user similarly rotating the key to access the secured area.

In embodiments having an access device with one or more electrical components, the device can be operated to change the lock from the unlocked state to the locked state, i.e., by moving or releasing the tumbler stopping member to a position underneath the tumblers. This can be accomplished selectively, such as by physically manipulating the key, or automatically, such as by removing the key from the lock or after a predetermined time has elapsed.

In some embodiments, the key can be a mechanical key that physically contacts and moves the tumbler stopping member 37 from underneath the tumbler pins 30 to unlock the lock mechanism.

Although the illustrated embodiments show one recess (with associated tumblers and locking bar) and one corresponding locking member receiving channel, it is recognized that the rotatable inner core can include more than one recess (each with associated tumblers and a locking bar) and more than one corresponding locking member receiving channel. For example, in some implementations, the rotatable inner core can have four recesses spaced an equal distance apart from each other around the core, with each recess having associated tumblers and a locking bar. The outer body can include four corresponding receiving channels within the outer body bore with each receiving a portion of one of the locking bars. Further, although two tumblers per recess are shown, it is recognized that one or more than two tumblers per recess can be used.

Although the recess 20 and projections 22 are formed in the rotatable inner core plug 18 and the locking member receiving channel 40 is formed in the outer body 14 in the illustrated embodiments, it is recognized that in some implementations, the recess and projections can be formed in the outer body and the locking member receiving channel can be formed in the inner core plug. Further, other components inserted into or housed within the rotatable inner core can be inserted into or housed within the lock outer body.

Unless otherwise noted, the various components of the lock mechanism described herein can be made from a strong, rigid material such as steel. Of course, in some applications, other materials can be used, such as, but not limited to, other metals, including aluminum, brass, stainless steel, zinc, nickel and titanium.

In view of the many possible embodiments to which the described principles may be applied, it should be recognized that the illustrated embodiments are only preferred examples and should not be taken as limiting in scope. Rather, the scope is defined by the following claims. We therefore claim as our invention all that comes within the scope and spirit of these claims.

We claim:

1. A portion of a lock, comprising:

a stationary member having a bore and being mountable to an object;

a movable member positioned at least partially within the bore and movable relative to the bore in an unlocking direction during a normal unlocking operation;

a non-resilient deformable portion positioned adjacent an interface between the stationary member and the movable member, the non-resilient deformable portion being fixed to one of the stationary member and the movable member, wherein the deformable portion permits the movable member to move in the unlocking direction during a normal unlocking operation, and wherein the deformable portion is deformable to prevent movement of the movable member relative to the stationary member when subjected to excessive force applied in an attempt to move the movable member in the unlocking direction in other than a normal unlocking operation; and a locking member comprising a locking bar extending along a longitudinal axis of the portion of the lock and comprising a first end and a second end, the first end being configured to move radially inward relative to the movable member, the locking member being engageable with the stationary member and the movable member to resist movement of the movable member relative to the stationary member, the locking member being positioned adjacent the deformable portion such that the excessive force applied to the movable member causes the first end of the locking member to deform the deformable portion.

2. The portion of a lock of claim 1, wherein the deformable portion is formed as one piece with the movable member.

3. The portion of a lock of claim 1, wherein the bore comprises a channel, and wherein at least a portion of the locking member is positionable in the channel to place the lock in a locked mode and removable from the channel to place the lock in an unlocked mode.

4. The portion of a lock of claim 3, wherein the deformable portion is positioned along at least one side of the channel adjacent the locking member.

5. The portion of a lock of claim 1, wherein the locking member applies a force against the deformable portion when the locking member is engaged with the stationary member and a torsional moment is applied to the movable member.

6. The portion of a lock of claim 1, further comprising at least one tumbler positioned within the movable member and contactable with the locking member, wherein the tumbler is raisable to urge the locking member into engagement with the stationary member and lowerable to move the locking member out of engagement with the stationary member.

7. The portion of a lock of claim 6, further comprising one or more biasing elements coupled to the at least one tumbler to bias the tumbler in a raised position.

8. The portion of a lock of claim 1, wherein the deformable portion comprises at least one outwardly extending projection.

9. The portion of a lock of claim 1, wherein the movable member comprises a recess formed therein, the recess having a ledge portion, wherein deformation of the deformable portion allows the locking member to contact the ledge portion and the stationary member thereby preventing movement of the movable member relative to the stationary member.

10. The portion of a lock of claim 1, further comprising a key engageable with the movable member to cause the locking member to disengage the stationary member, thereby allowing movement of the movable member relative to the stationary member.

11. The portion of a lock of claim 10, wherein the key comprises a memory containing lock access information, wherein the movable member comprises an electronic circuit coupled to an actuating device, and wherein the circuit receives the lock access information stored in the key memory and activates the actuating device to disengage the locking member from the stationary member.

12. The portion of a lock of claim 1, wherein the movable member is rotatable relative to the stationary member.

13. An anti-attack portion of a lock, comprising:

a stationary outer body comprising a generally circular bore having a contiguous channel formed therein;

a rotatable generally cylindrical inner core positioned at least partially within the circular bore and rotatable relative to the stationary outer body, the rotatable cylindrical inner core having a recess formed therein;

non-resilient deformable members adjacent an interface between the stationary outer body and the rotatable cylindrical inner core; and a movable locking member comprising a locking bar extending along a longitudinal axis of the portion of the lock and comprising a first end and a second end, the first end being configured to move radially inward relative to the rotatable cylindrical inner core, the movable locking member being positioned at least partially within the recess and between the deformable members such that the deformable members are adjacent laterally opposed sides of the movable locking member, a portion of the movable locking member being engageable with the channel to resist rotation of the inner core relative to the outer body when the lock is in a locked state and disengageable from the channel when the lock is in an unlocked state;

wherein rotation of the inner core relative to the outer body when the lock is in the locked state urges the locking member against at least one of the deformable members, and wherein further rotation exceeding a predetermined torsional force causes the locking member to deform at least one of the deformable members, thereby preventing rotation of the inner core relative to the outer body.

14. The anti-attack portion of a lock of claim 13, wherein the deformable members comprise one or more projections extending from the cylindrical inner core.

15. The anti-attack portion of a lock of claim 13, wherein the deformable members comprise one or more non-resilient members fixed to the cylindrical inner core.

16. The anti-attack portion of a lock of claim 13, wherein the portion of the movable locking member is movable away from the channel to place the lock in an unlocked state and allow rotation of the inner core relative to the outer body.

17. The anti-attack portion of a lock of claim 13, further comprising a key engageable with the rotatable cylindrical inner core, the key causing the locking member to move away from the channel.

18. The anti-attack portion of a lock of claim 17, wherein the key comprises a memory containing lock access information, wherein the inner core comprises an electronic circuit coupled to an actuating device, and wherein the circuit receives the lock access information stored in the memory and activates the actuating device to cause the locking member to move away from the channel.

19. The anti-attack portion of a lock of claim 13, further comprising one or more movable tumbler pins positioned within the inner core and coupled to the locking member, wherein in the locked state, the tumbler pins are blocked from movement to maintain engagement between the locking member and the channel and in the unlocked state, the tumbler pins are unblocked from movement to allow the locking member to disengage from the channel.

20. A portion of a lock, comprising:

a stationary member having a bore and being mountable to an object;

a movable member positioned at least partially within the bore and movable relative to the bore in an unlocking direction during a normal unlocking operation;

a non-resilient deformable portion positioned adjacent an interface between the stationary member and the movable member, wherein the deformable portion permits the movable member to move in the unlocking direction during a normal unlocking operation; and a locking member comprising a locking bar extending along a longitudinal axis of the portion of the lock and comprising a first end and a second end, the first end being configured to move radially inward relative to the movable member, the locking member being engageable with the stationary member and the movable member to resist movement of the movable member relative to the stationary member, the locking member being positioned adjacent the deformable portion such that an excessive force applied to the movable member in the unlocking direction in other than the normal unlocking operation causes the locking member to deform the deformable portion and occupy a void created by the deformation of the deformable portion.

* * * * *